US010096407B2

(12) United States Patent
Tseng et al.

(10) Patent No.: US 10,096,407 B2
(45) Date of Patent: Oct. 9, 2018

(54) SURFACE-MOUNTABLE OVER-CURRENT PROTECTION DEVICE

(71) Applicant: Polytronics Technology Corp., Hsinchu (TW)

(72) Inventors: Chun Teng Tseng, Sanwan Township, Miaoli County (TW); Wen Feng Lee, Taoyuan (TW); Yung Hsien Chang, Douliu (TW); Yao Te Chang, Linnei Township, Yunlin County (TW)

(73) Assignee: POLYTRONICS TECHNOLOGY CORP., Hsinchu (TW)

( * ) Notice: Subject to any disclaimer, the term of this patent is extended or adjusted under 35 U.S.C. 154(b) by 87 days.

(21) Appl. No.: 15/437,975

(22) Filed: Feb. 21, 2017

(65) Prior Publication Data

US 2018/0033527 A1 Feb. 1, 2018

(30) Foreign Application Priority Data

Jul. 29, 2016 (TW) ..... 105124066 A

(51) Int. Cl.
*H01C 7/02* (2006.01)
*H01C 7/13* (2006.01)

(52) U.S. Cl.
CPC ..... *H01C 7/021* (2013.01); *H01C 7/13* (2013.01)

(58) Field of Classification Search
CPC ..... H01C 7/021; H01C 7/13; H01C 1/142; H01C 1/1406; H01C 1/148; H05K 7/00
USPC ..... 338/13, 312
See application file for complete search history.

(56) References Cited

U.S. PATENT DOCUMENTS 6,377,467 B1 4/2002 Chu et al.
2014/0118871 A1* 5/2014 Tseng ..... H01C 17/00 361/58
2014/0285938 A1* 9/2014 Tseng ..... H01C 7/021 361/93.8

FOREIGN PATENT DOCUMENTS

CN 201994151 U 9/2011

* cited by examiner

*Primary Examiner* — Kyung Lee
*Assistant Examiner* — Iman Malakooti
(74) *Attorney, Agent, or Firm* — Muncy, Geissler, Olds & Lowe, P.C.

(57) ABSTRACT

A surface mountable over-current protection device comprises a PTC material layer, first and second conductive layers, left and right electrodes, left and right conductive members, and left and right insulating members. The PTC material layer comprises a left notch at a left end and a right notch at a right end. The first conductive layer comprises a primary portion disposed on an upper surface of the PTC material layer and a secondary portion extending over the left notch, and the second conductive layer comprises a primary portion disposed on a lower surface of the PTC material layer and a secondary portion extending over the underside of the right notch. The left conductive member connects to the left electrode and the first conductive layer and isolates from the second conductive layer. The right conductive member connects to the right electrode and the second conductive layer and isolates from the first conductive layer. The left and right insulating members are disposed in the left and right notches, respectively. The PTC material layer is not in direct contact with the left and right conductive members, and the primary portion and the secondary portion of the first or second conductive layer have different thicknesses.

16 Claims, 12 Drawing Sheets

SURFACE-MOUNTABLE OVER-CURRENT PROTECTION DEVICE

BACKGROUND OF THE INVENTION

(1) Field of the Invention

The present application relates to an over-current protection device, and more specifically, to a surface-mountable over-current protection device adapted to withstand high voltages.

(2) Description of the Related Art

Over-current protection devices are used for circuit protections to prevent circuits from being damaged due to over-current or over-temperature events. An over-current protection device usually contains two electrodes and a resistive material disposed therebetween. The resistive material has positive temperature coefficient (PTC) characteristic; that is, the resistance of the PTC material remains extremely low at a normal temperature; however when an over-current or an over-temperature occurs in the circuit, the resistance instantaneously increases to a high resistance state (i.e., trip) to diminish the current for circuit protection. When the temperature decreases to room temperature or over-current no longer exists, the over-current protection device returns to low resistance state so that the circuit operates normally again. Because the PTC over-current protection devices can be reused, they can replace fuses and are widely applied to high-density circuitries.

In general, the PTC conductive composite material contains crystalline polymer and conductive filler. The conductive filler is dispersed uniformly in the crystalline polymer. The crystalline polymer is usually a polyolefin polymer such as polyethylene. The conductive filler usually contains carbon black powder, metal or ceramic conductive fillers.

The most widely used surface-mountable over-current protection device is disclosed in U.S. Pat. No. 6,377,467. The device comprises conductive through holes to connect metal foils on surfaces of a PTC material layer and electrodes on the outer surfaces of the device to form conductive paths. For high voltage applications, e.g., 6V or 30V, it usually decreases the amount of the conductive fillers such as carbon black or conductive ceramic powder. This however decreases hold current of the device, and the requirements of high voltage endurance and high hold current cannot be met simultaneously. The surface-mountable over-current protection device is usually made through PCB process in which circuits are formed by etching. However, in the event of, for example, inaccurate positions of etching, copper foil residue due to incomplete etching or defective connections of conductive through holes, an electric arc may occur. In addition, if etchant remains after process, the ability to withstand voltages may be diminished.

The resistance of the PTC protection device increases tremendously when protection is triggered, and therefore the protection device withstands the majority of voltage in the circuit. The PTC protection device for communication and automotive apparatuses is demanded to withstand a large voltage during malfunction. Because the sides of the PTC material layer are in direct contact with the conductive through holes in a traditional device, an electric arc may occur to induce safety issues including electric breakthrough, spark and flame in the PTC protection device. Therefore, the traditional PTC protection device needs to be improved to withstand higher voltages.

A Chinese patent CN201994151U disclosed a surface-mountable polymeric PTC protection device in which insulating blocks are embedded into two notches of a PTC chip including a PTC material layer and copper foils disposed thereon so as to enhance anti-arc ability. The notches of the PTC chip are made by drilling blind holes, and the notches are aligned with the two notches, i.e., conductive through holes, at the two ends of the PTC protection device. The making of a blind hole is to drill through an upper copper foil and the PTC material layer and stop at a lower copper foil. In contrast, the making of another blind hole is to drill through the lower copper foil and the PTC material layer and stop at the upper copper foil. However, the depths of the blind holes may not be controlled accurately; it is likely to drill through the upper or lower copper foil to cause open-circuits or make a thin upper or lower copper foil to induce unstable electrical conduction, resulting in low yield or inferior electrical performance.

Moreover, in the following step to press "prepreg" into the blind holes, incomplete insertion or bubble may occur and impact the product performance. It is noted that prepreg is "pre-impregnated" composite fibers where a matrix material, such as epoxy, is already present. For large, high aspect ratio blind holes or a number of blind holes, the amount of prepreg may not be sufficient to be completely filled into large and deep blind holes. As a result, bubbles, recesses or insufficient thicknesses of the insulating blocks in the blind holes may occur, and these events impact the reliability of the products. Prepreg has relatively high coefficient of thermal expansion (CTE), and therefore it may have cracks or delamination during thermal processes such as thermal shock or thermal stress reliability tests. Both significantly different CTE of two materials and bubbles in the prepreg are the primary reasons for the aforesaid defectiveness.

SUMMARY OF THE INVENTION

To resolve the problems that the surface-mountable over-current protection device cannot withstand high voltages, the present application devised a surface-mountable over-current protection device having better electrical insulating performance to avoid an unexpected electric arc so as to sustain high hold current and provide over-current protection endurable for a high voltage such as 6V, 30V or more than 30V.

In accordance with an embodiment of the present application, a surface-mountable over-current protection device comprises a PTC material layer, first and second conductive layers, left and right electrodes, left and right conductive members, and left and right insulating members. The PTC material layer comprises a left notch at a left end and a right notch at a right end. The first conductive layer comprises a primary portion disposed on an upper surface of the PTC material layer and a secondary portion extending over the left notch, and the second conductive layer comprises a primary portion disposed on a lower surface of the PTC material layer and a secondary portion extending over the underside of the right notch. The left electrode electrically connects to the first conductive layer, and the right electrode electrically connects to the second conductive layer. The left conductive member connects to the left electrode and the first conductive layer, and isolates from the second conductive layer. The right conductive member connects to the right electrode and the second conductive layer, and isolates from the first conductive layer. The left insulating member is disposed in the left notch and between the left conductive member and the PTC material layer for isolation. The right insulating member is disposed in the right notch and between the right conductive member and the PTC material layer for isolation. The PTC material layer is not in direct contact with the left and right conductive members, and the primary portion and the secondary portion of the first or second conductive layer have different thicknesses.

In an embodiment, the first conductive layer and the second conductive layer have thicker primary portions than secondary portions.

In an embodiment, the primary portion of the first or second conductive layer is a laminate comprising a first metal layer and a second metal layer, and the secondary portion of the first or second conductive layer comprises the second metal layer.

In an embodiment, the second metal layer is an electroplated layer in contact with the first metal layer.

In an embodiment, the left insulating member and the right insulating member are in the shape of a half cylinder, and the ratio of the height to the radius of the half cylinder is in the range of 1-15.

In an embodiment, the first conductive layer has a right end with a notch which is aligned with the right notch. The second conductive layer has a left end with a notch which is aligned with the left notch.

In an embodiment, the left and right notches are in semi-circular or semi-ellipse shapes, and the left conductive member and the right conductive member are semi-circular or semi-ellipse conductive through holes.

In an embodiment, the surface-mountable over-current protection device further comprises a first insulating layer and a second insulating layer. The first insulating layer is in contact with an upper surface of the first conductive layer from the left conductive member to the right conductive member. The second insulting layer is in contact with a lower surface of the second conductive layer from the left conductive member to the right conductive member.

In an embodiment, each of the left electrode and the right electrode has two electrode sections disposed on an upper surface of the first insulating layer and a lower surface of the second insulating layer.

In an embodiment, the first insulating layer and the second insulating layer comprise prepreg.

In an embodiment, the material of the first and second insulating layers is different from that of the left insulating member and the right insulating member.

In an embodiment, the CTE in vertical direction of the left and right insulating members is smaller than the CTE in vertical direction of the first and second insulating layers.

In an embodiment, the left insulating member and the right insulating member comprise insulating resin which excludes fiberglass.

In an embodiment, the CTE of the insulating resin below Tg is less than 50 ppm, and Tg is equal to or greater than 140° C.

In an embodiment, the insulating resin has a viscosity of 30-60 Pa·s at 25° C.

In an embodiment, the left and right insulating members comprise insulating resin with fillers selected from the group consisting of $SiO_2$, $TiO_2$, $Al_2O_3$, $Al(OH)_3$ and $Mg(OH)_2$.

In accordance with the present application, the surface-mountable over-current protection device employs the left and right insulating members to isolate the PTC material layer from the left and right conductive members, i.e., they are not in direct or physical contact with each other, so as to increase insulation performance for high voltage endurance. The left and right insulating members may use insulating resin with specific viscosity and CTE, so that it is suitable for the process relating to large holes and holes of high aspect ratio. This overcomes the problems of incomplete filling, bubbles, cracks and delamination. In addition, a surface-mountable over-current protection device with multiple PTC material layers in parallel connection can be accordingly made to obtain lower resistance and sustain high voltage endurance.

BRIEF DESCRIPTION OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 1A:
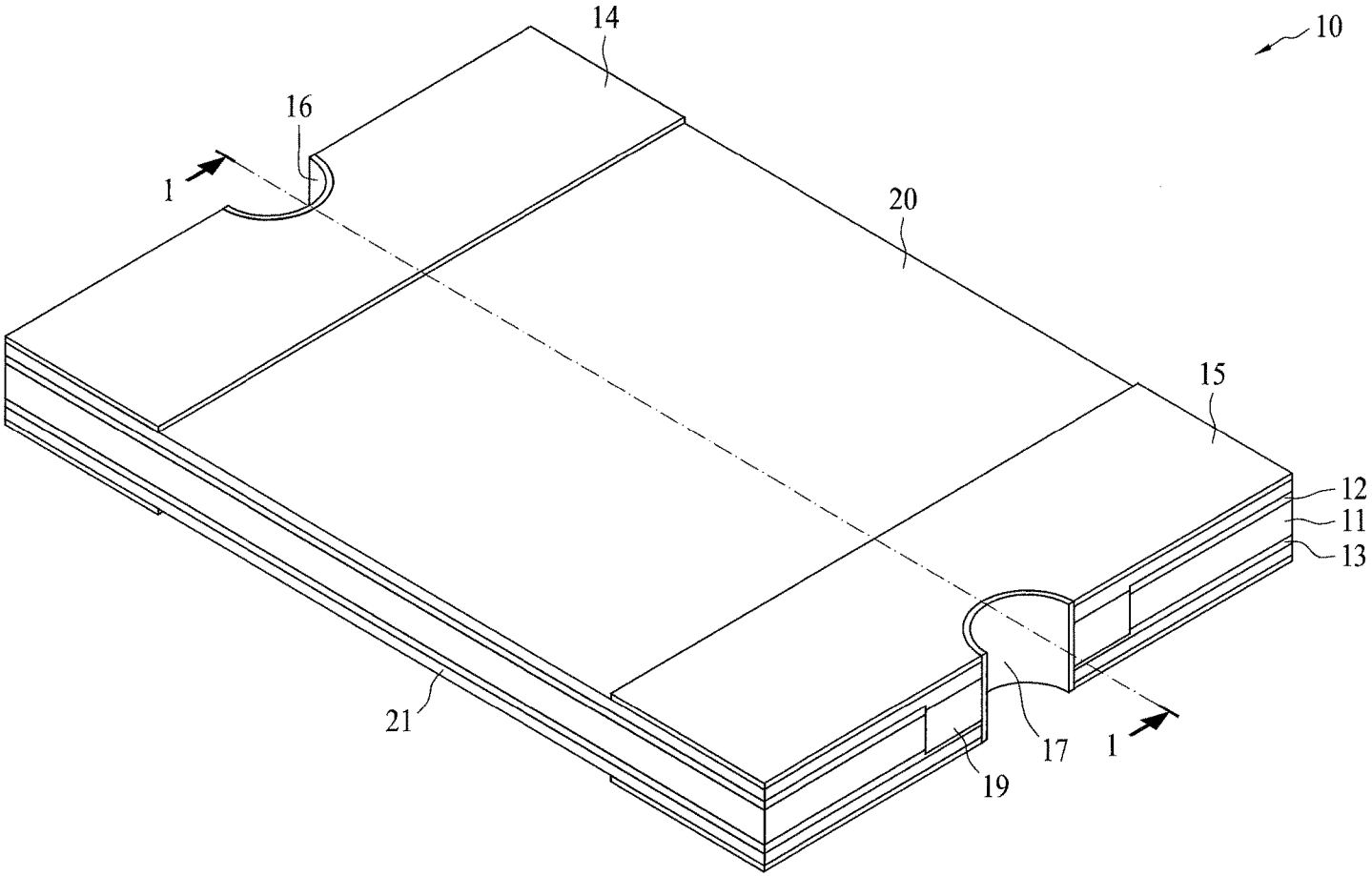
FIGS. 1A and 1B show a surface-mountable over-current protection device in accordance with a first embodiment of the present application.
Figure 1B:
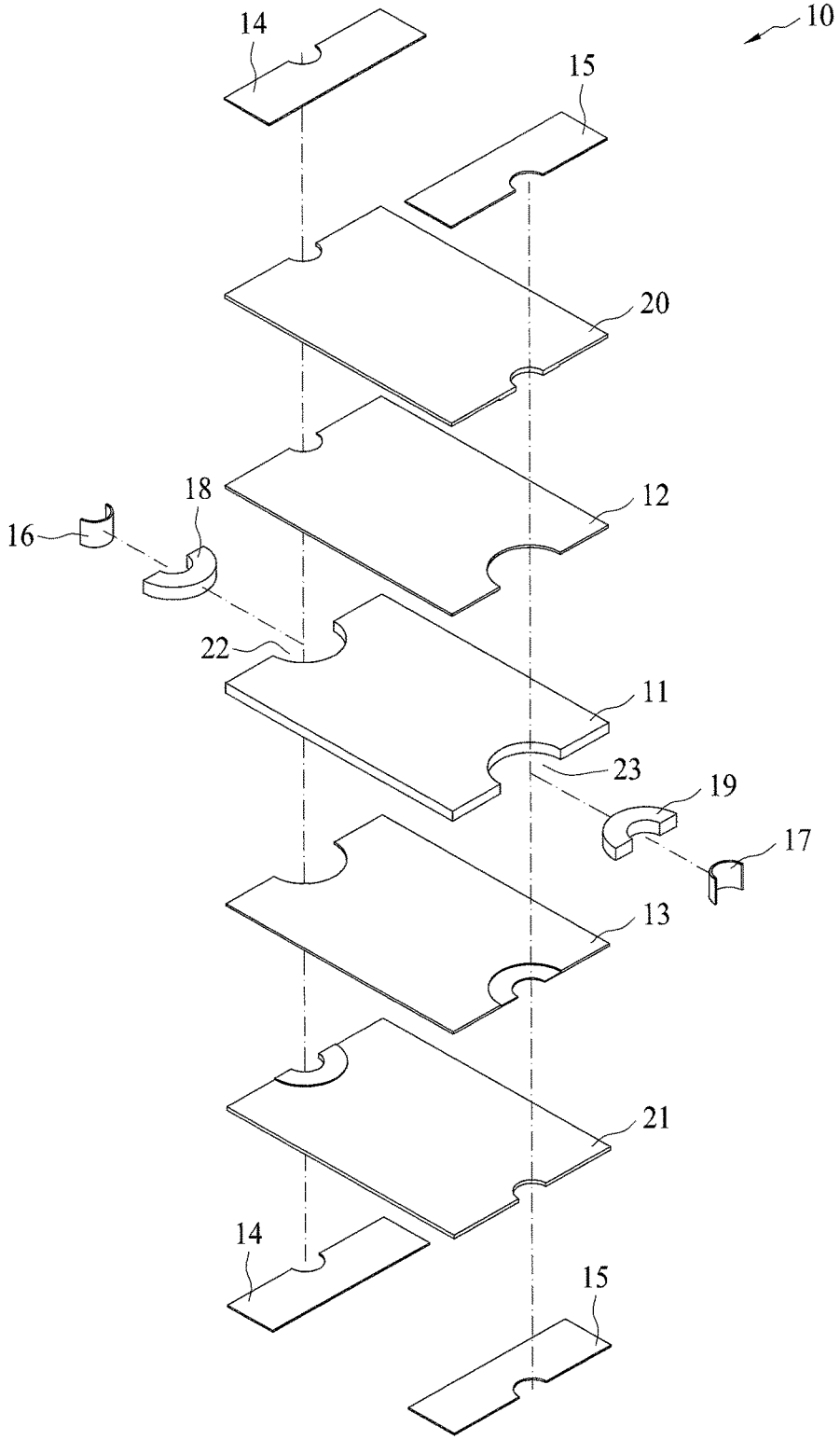
Figure 2A:
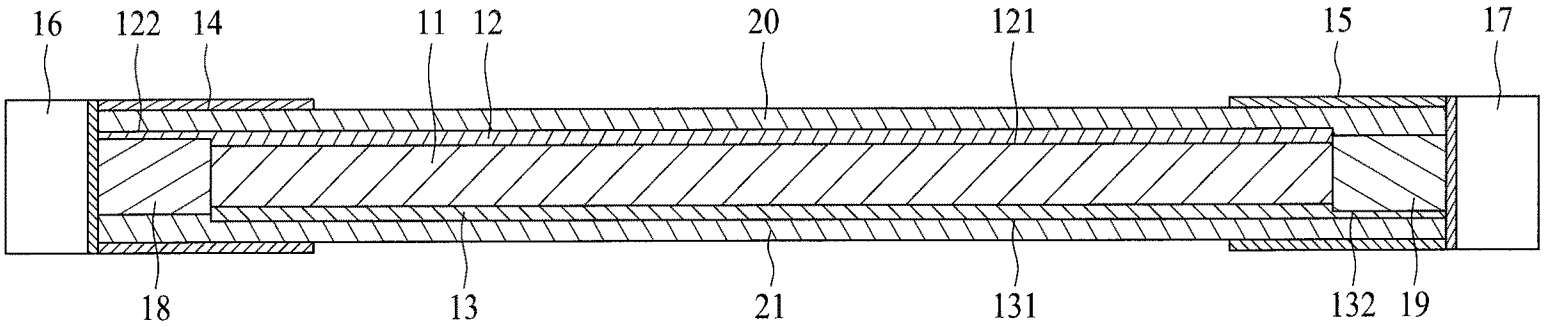
FIG. 2A shows a cross-sectional view along line 1-1 of FIG. 1A.
Figure 2B:
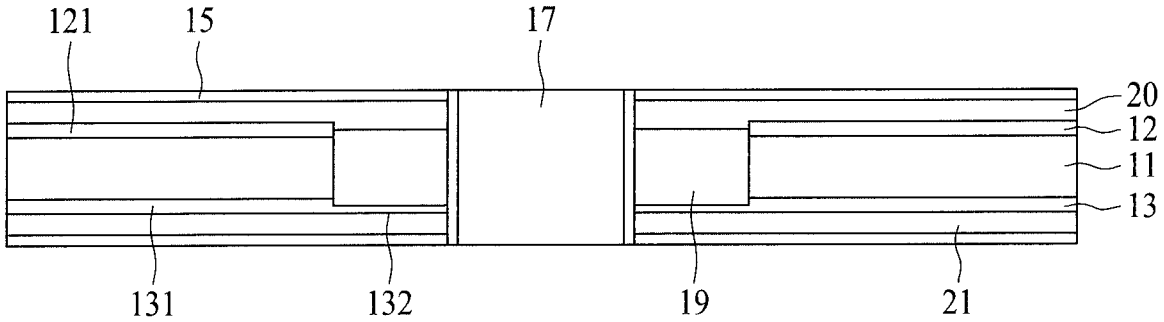
FIGS. 2B and 2C show right-hand and left-hand side views of the surface-mountable over-current protection device of FIG. 1A, respectively.
Figure 2C:
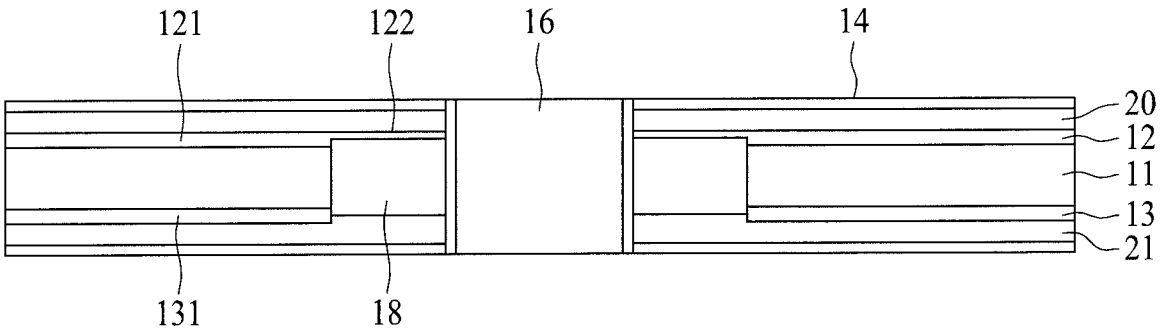

FIG. 1A shows a surface-mountable over-current protection device 10 in accordance with a first embodiment of the present application. FIG. 1B shows an exploded diagram of the surface-mountable over-current protection device 10. FIG. 2A shows a cross-sectional view along line 1-1 of FIG. 1A. FIG. 2B shows a right-hand side view of the surface-mountable over-current protection device 10 in FIG. 1A, whereas FIG. 2C shows a left-hand side view of the surface-mountable over-current protection device 10 in FIG. 1A. The surface-mountable over-current protection device 10 is a laminated structure having a plurality of layers, including a PTC material layer 11, a first conductive layer 12, a second conductive layer 13, a left electrode 14, a right electrode 15, a left conductive member 16, a right conductive member 17, a left insulating member 18, a right insulating member 19, a first insulating layer 20 and a second insulating layer 21. The PTC material layer 11 has a left end and a right end opposite to each other. The left end comprises a left notch 22 to receive the left insulating member 18, and the right end comprises a right notch 23 to receive the right insulating member 19. The PTC material layer 11 may comprise crystalline polymer and conductive filler dispersed therein. The conductive filler comprises carbon black, metal or conductive ceramic powder. The right end of the first conductive layer 12 has a notch aligned with the right notch 23. The left end of the second conductive layer 13 has a notch aligned with the left notch 22. The first conductive layer 12 comprises a primary portion 121 disposed on an upper surface of the PTC material layer 11 and a secondary portion 122 extending over the left notch 22. More specifically, the secondary portion 122 is disposed on a surface of the left insulating member 18. The second conductive layer 13 comprises a primary portion 131 disposed on a lower surface of the PTC material layer 11 and a secondary portion 132 extending over the underside of the right notch 23. More specifically, the secondary portion 132 is disposed on a surface of the right insulating member 19. The left electrode 14 electrically connects to the first conductive layer 12 through the left conductive member 16. The right electrode 15 electrically connects to the second conductive layer 13 through the right conductive member 17. In particular, the left conductive member 16 connects to the left electrode 14 and the first conductive layer 12, and isolates from the second conductive layer 13. The right conductive member 17 connects to the right electrode 15 and the second conductive layer 13, and isolates from the first conductive layer 12. The left insulating member 18 is disposed in the left notch 22 and between the left conductive member 16 and the PTC material layer 11 for isolation. The right insulating member 19 is disposed in the right notch 23 and between the right conductive member 17 and the PTC material layer 11 for isolation. The first insulating layer 20 is in contact with an upper surface of the first conductive layer 12 and extends from the left conductive member 16 to the right conductive member 17. The second insulating layer 21 is in contact with a lower surface of the second conductive layer 13 and extends from the left conductive member 16 to the right conductive member 17. In an embodiment, the left notch 22 and the right notch 23 of the PTC material layer 11 are in semi-circular or semi-ellipse shapes, and the left and right conductive members 16 and 17 are conductive through holes of semi-circular or semi-ellipse shapes. In practice, the left notch and the right notch may be of rectangular shapes, and the left conductive member and the right conductive member may be full-face member at left and right lateral surfaces. Each of the left and right electrodes 14 and 15 has two electrode sections on an upper surface of the first insulating layer 20 and a lower surface of the second insulating layer 21 for surface-mounting onto a circuit board.

As a result of the manufacturing process, each of the first conductive layer 12 and the second conductive layer 13 does not have a constant thickness. The primary portion 121 and the secondary portion 122 of the first conductive layer 12 are of different thicknesses. More specifically, the primary portion 121 is thicker than the secondary portion 122. In other words, the portion of the first conductive layer 12 in contact with the upper surface of the PTC material layer 11 is thicker than the portion of the first conductive layer 12 in contact with the upper surface of the left insulating member 18. Similarly, the primary portion 131 and the secondary portion 132 of the second conductive layer 13 are of different thicknesses. More specifically, the primary portion 131 is thicker than the secondary portion 132. In other words, the portion of the second conductive layer 13 in contact with the lower surface of the PTC material layer 11 is thicker than the portion of the second conductive layer 13 in contact with the lower surface of the right insulating member 19. In an embodiment, each of the first conductive layer 12 and the second conductive layer 13 comprises a structure including two metal layers. Each of the primary portions 121 and 131 is a laminate comprising a first metal layer and a second metal layer, and each of the secondary portions 122 and 132 comprises the second metal layer.

Figure 3A:
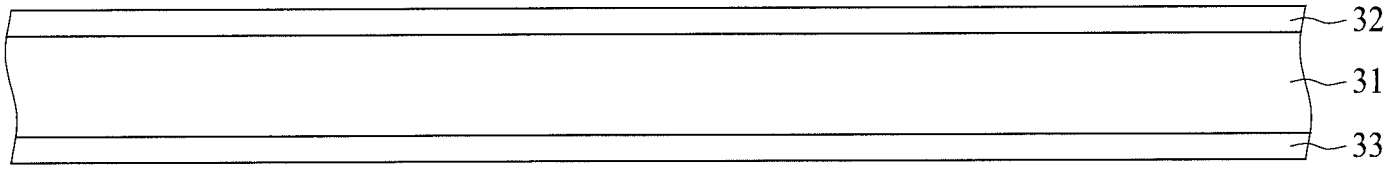
FIGS. 3A to 3E show a process of making a surface-mountable over-current protection device in accordance with an embodiment of the present application.
Figure 3B:
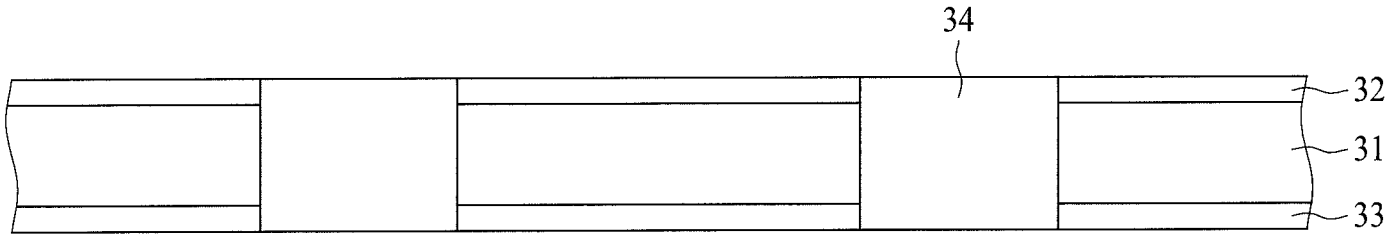
Figure 3C:
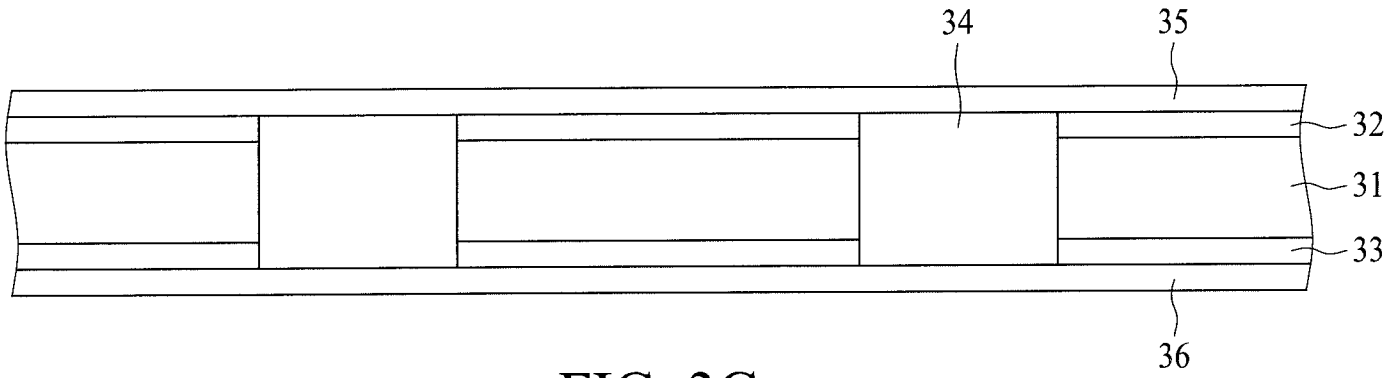
Figure 3D:
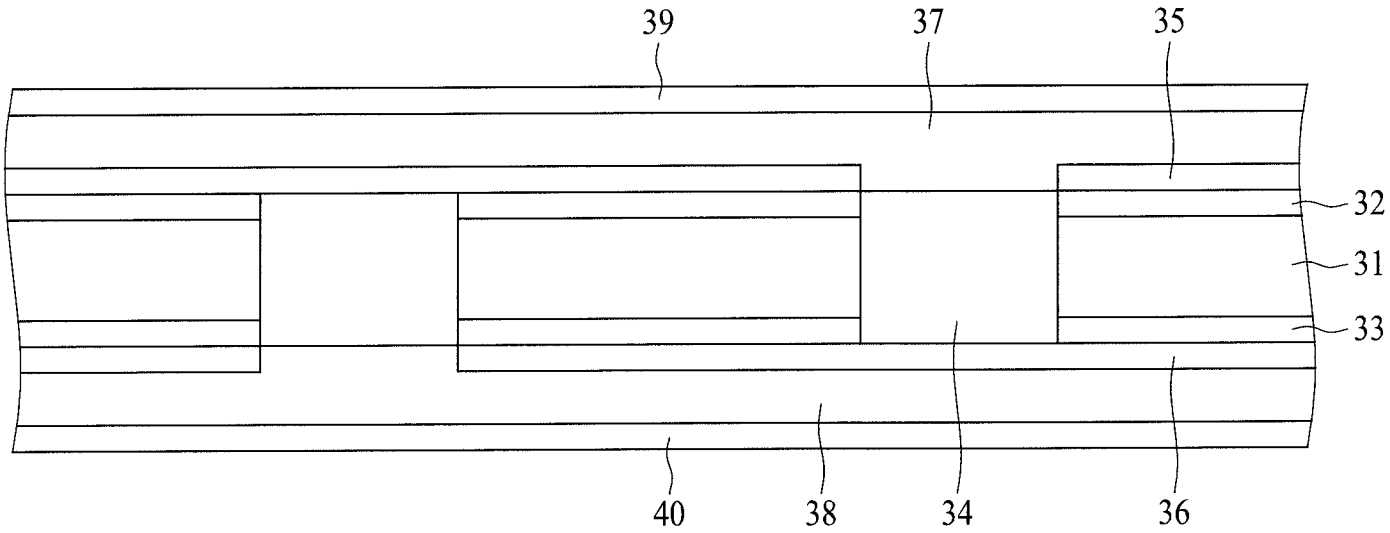
Figure 3E:
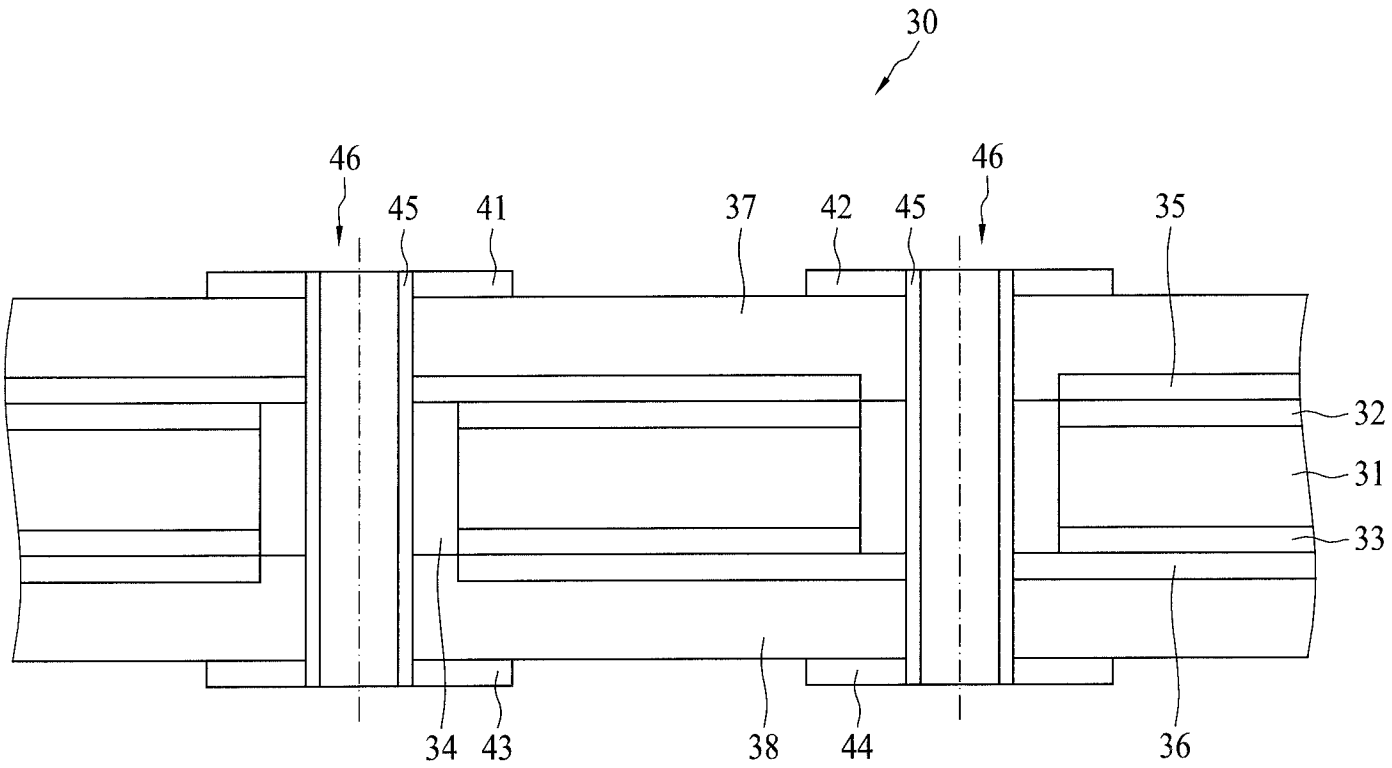

FIG. 3A to FIG. 3E show a manufacturing process of a surface-mountable over-current protection device in accordance with an embodiment of the present application. The polymeric PTC composite material is pressed to a PTC material layer 31 of, for example, 200 mm (length)×200 mm (width)×0.38 mm (thickness), and then two first metal layers 32 and 33 are attached to upper and lower surfaces of the PTC material layer 31. The PTC material layer 31 is disposed between the first metal layers 32 and 33 and hot-pressed to be a substrate as shown in FIG. 3A. The first metal layers 32 and 33 may be copper foils or other metal foils attached to the PTC material layer 31. In FIG. 3B, the substrate is drilled or punched to form a plurality of through holes, and the through holes are filled with insulating material 34 such as an insulating resin without fiberglass by screen printing or scraper daubing. The insulating resin 34 may comprise fillers such as $SiO_2$, $TiO_2$, $Al_2O_3$, $Al(OH)_3$, $Mg(OH)_2$ or mixture thereof to alleviate expansion and obtain small CTE. After filling, the holes may be bulged with the insulating material 34, and therefore a planarization process may need to be performed. In FIG. 3C, the second metal layers 35 and 36 are formed on the upper and lower surfaces of the substrate by, for example, electroplating. In FIG. 3D, some areas of the second metal layers 35 and 36 corresponding to the insulating materials 34 are removed by etching to expose one side of the insulating materials 34. In this embodiment, the areas of the second metal layers 35 and 36 on the adjacent insulating materials 34 are removed at opposite sides by etching. Sequentially, a first insulating layer 37, a second insulating layer 38, and electrode layers 39 and 40 are formed on upper and lower surfaces of the substrate by pressing. The first insulating layer 37 and the second insulating layer 38 may comprise prepreg. In FIG. 3E, the substrate at which the insulating materials 34 are located is vertically drilled to form holes 46. The diameter of the hole 46 is smaller than that of the through hole made previously. That is, the diameter of the hole 46 is smaller than that of the insulating material 34. To reduce misalignment, the drilling center this time has to be consistent with the previous drilling center to ensure that the holes 46 are located at the centers of the insulating materials 34. The sidewalls of the holes 46 are electroplated with conductive films to form conductive members 45. The upper electrode layer 39 in which the central portion between adjacent holes 46 is removed by etching to form a left electrode section 41 and a right electrode section 42. The lower electrode layer 40 in which the central portion between adjacent holes 46 is removed by etching to form a left electrode section 43 and a right electrode section 44. The substrate through which the center of each hole 46 is cut to form two semi-circular or semi-ellipse holes, thereby forming surface-mountable over-current protection devices 30. The left electrode section 41 is associated with the left electrode section 43 to form a left electrode which electrically connects to the second metal layer 35 through the conductive member 45. The right electrode section 42 is associated with the right electrode section 44 to form a right electrode which electrically connects to the second metal layer 36. The surface-mountable over-current protection device 30 is substantially equivalent to the surface-mountable over-current protection device 10 shown in FIG. 1A and FIG. 1B. To clearly describe the making process of the over-current protection device, the dimensions in FIGS. 3A to 3E are illustratively only and may differ from those shown in FIGS. 1A to 2C. In an embodiment, the insulating material 34 at left side of the surface-mountable over-current protection device 30 corresponds to the left insulating member 18 of the surface-mountable over-current protection device 10, and the insulating material 34 at right side of the surface-mountable over-current protection device 30 corresponds to the right insulating member 19 of the surface-mountable over-current protection device 10. The combination of the first metal layer 32 and the second metal layer 35 of the surface-mountable over-current protection device 30 corresponds to the first conductive layer 12 of the surface-mountable over-current protection device 10. The combination of the first metal layer 33 and the second metal layer 36 of the surface-mountable over-current protection device 30 corresponds to the first conductive layer 13 of the surface-mountable over-current protection device 10.

Preferably, the insulating material 34 may contain insulating resin with the features: (1) In absence of solvent and small CTE to prevent cracks and delamination during thermal processes. The CTE of the insulating resin is smaller than 50 ppm at a temperature below the glass transition temperature "Tg." (2) Without recesses of the insulating materials 34 filled in through holes, i.e., the insulating materials 34 are of flat surfaces. (3) Good adhesion between the insulating material 34 and the conductive member 45 which may be copper-plated sidewall of the hole. (4) Tg is greater than 140° C. (5) Viscosity at 25° C. is about 30-60 Pa·s to sustain good flowability for filling into holes. Because the insulating material 34 contains such features different from the first insulating layer 37 and the second insulating layer 38, incomplete filling, bubbles, cracks or delamination will not happen. Compared to pressing the FR4 prepreg into holes, the insulating material 34 is more suitable for filling large and high aspect ratio holes. In an embodiment, the diameter of drilling, i.e., the diameter of the insulating material 34, is about 0.4-3 mm. The total thickness of the PTC material layer 31 and the upper and lower first metal layers 32 and 33, i.e., the thickness of the insulating material 34, is about 0.2-3 mm. After cutting, the insulating material 34 is divided into a left insulating member and a right insulating member, and these insulating members are in the shape of a half cylinder. The ratio of height to radius of the half cylinder is approximately 1-15, e.g., 1.5, 2, 3, 5 or 10. In FIG. 1B, the left insulating member 18 or the right insulating member 19 may be of a half cylinder with a central notch. In an embodiment, the insulating material 34 including a left insulating member and a right insulating member has smaller vertical CTE than the first insulating layer 37 and the second insulating layer 38, so as to avoid cracks and delamination of the insulating material 34 and deformation of the second metal layers 35 and 36.

Figure 4:
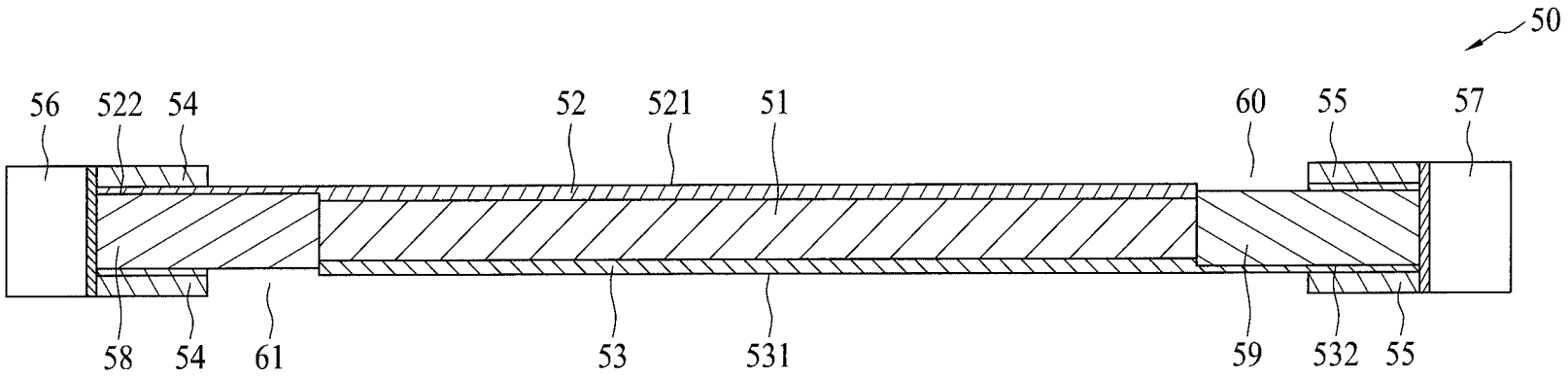
FIG. 4 shows a cross-sectional view of a surface-mountable over-current protection device in accordance with a second embodiment of the present application.

FIG. 4 shows a cross-sectional view of a surface-mountable over-current protection device 50 in accordance with a second embodiment of the present application. The surface-mountable over-current protection device 50 is a laminated structure having a plurality of layers, including a PTC material layer 51, a first conductive layer 52, a second conductive layer 53, a left electrode 54, a right electrode 55, a left conductive member 56, a right conductive member 57, a left insulating member 58 and a right insulating member 59. The PTC material layer 51 has a left end and a right end opposite to each other. The left end comprises a left notch to receive the left insulating member 58, and the right end comprises a right notch to receive the right insulating member 59. The first conductive layer 52 comprises a primary portion 521 disposed on an upper surface of the PTC material layer 51 and a secondary portion 522 extending over the left notch or the left insulating member 58. The second conductive layer 53 comprises a primary portion 531 disposed on a lower surface of the PTC material layer 51 and a secondary portion 532 extending over the underside of the right notch or the right insulating member 59. The first conductive layer 52 and the second conductive layer 53 may be provided with solder masks thereon. The left electrode 54 comprises upper and lower electrode sections electrically connecting to the first conductive layer 52 through the left conductive member 56. The right electrode 55 comprises upper and lower electrode sections electrically connecting to the second conductive layer 53 through the right conductive member 57. More specifically, the left conductive member 56 connects to the left electrode 54 and the first conductive layer 52, and isolates from the second conductive layer 53. The right conductive member 57 connects to the right electrode 55 and the second conductive layer 53, and isolates from the first conductive layer 52. In an embodiment, the first conductive layer 52 has a notch 60 to isolate the first conductive layer 52 from the right electrode 55. Preferably, the notch 60 is on the right insulating member 59 to prevent physical contact and electrical connection between the PTC material layer 51 and the upper right electrode 55. The second conductive layer 53 has a notch 61 to isolate the second conductive layer 53 from the left electrode 54. Preferably, the notch 61 is on the underside of the left insulating member 58 to prevent physical contact and electrical connection between the PTC material layer 51 and the lower left electrode 54. The left insulating member 58 is disposed between the left conductive member 56 and the PTC material layer 51 for isolation. The right insulating member 59 is disposed between the right conductive member 57 and the PTC material layer 51 for isolation. This embodiment is similar to the first embodiment except the exclusion of insulating layers. This enhances heat dissipation and as a result the hold current of the device increases also. Moreover, in absence of insulating layers, the height of the device can be reduced.

Figure 5:
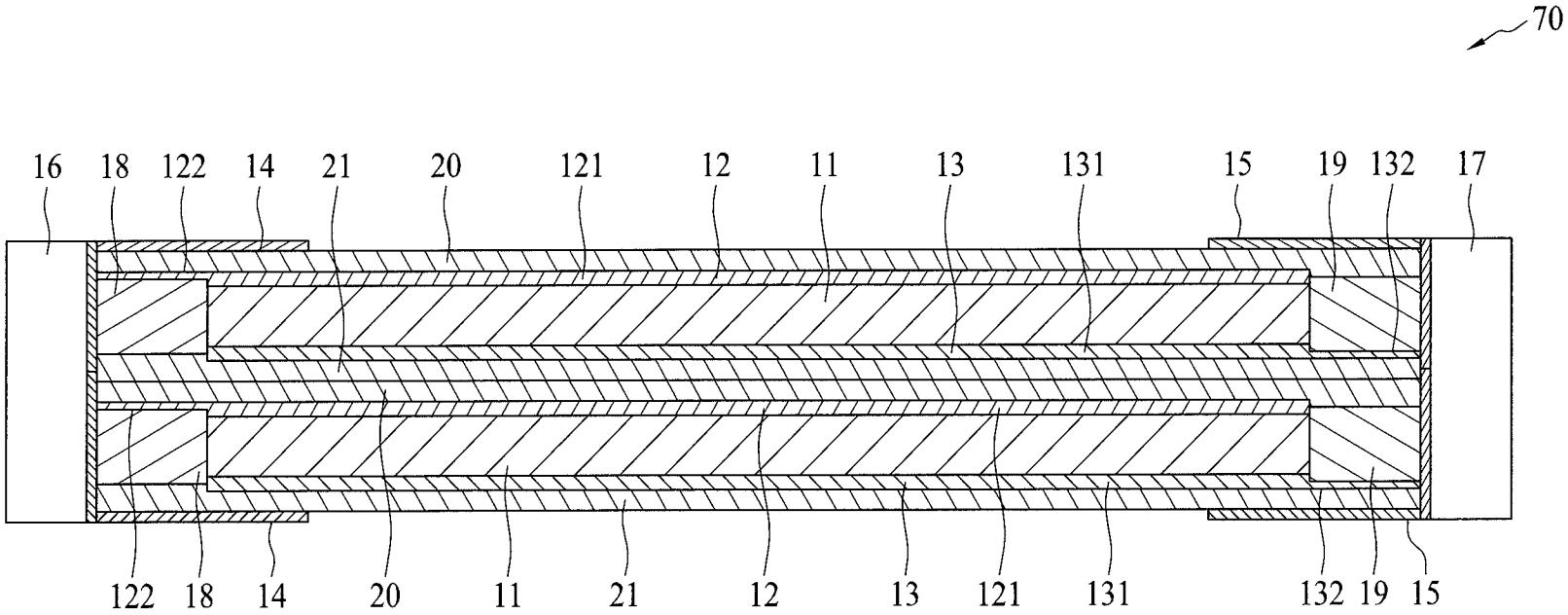
FIG. 5 shows a cross-sectional view of a surface-mountable over-current protection device in accordance with a third embodiment of the present application.

FIG. 5 shows a cross-sectional view of a surface-mountable over-current protection device 70 in accordance with a third embodiment of the present application. It resembles a stacked structure of two surface-mountable over-current protection devices 10 with commonly used left conductive member 16 and the right conductive member 17. As a result, the two PTC material layers 11 are in parallel connection to form a circuit of two PTC resistors connected in parallel, so as to decrease the resistance. The surface-mountable over-current protection device 70 comprises two PTC material layers 11, and first and second conductive layers 12 and 13 are disposed on the upper and lower surfaces of each of the PTC material layer 11. A surface of each first conductive layer 12 is provided with a first insulating layer 20, and a surface of each second conductive layer 13 is provided with a second insulating layer 21. Each of the PTC material layers 11 has a left notch receiving a left insulating member 18 at a left end and a right notch receiving a right insulating member 19 at a right end. Each first conductive layer 12 has a notch aligned with the right notch at the right end, and each second conductive layer 13 has a notch aligned with the left notch at the left end. Each of the first conductive layers 12 comprises a primary portion 121 disposed on an upper surface of the PTC material layer 11 and a secondary portion 122 extending over the left notch. More specifically, the secondary portion 122 is disposed on the left insulating member 18. Each of the second conductive layers 13 comprises a primary portion 131 disposed on a lower surface of the PTC material layer 11 and a secondary portion 132 extending over the underside of the right notch. More specifically, the secondary portion 132 is disposed on a surface of the right insulating member 19. The left electrode 14 electrically connects to each of the first conductive layers 12 through the left conductive member 16. The right electrode 15 electrically connects to each of the second conductive layers 13 through the right conductive member 17. The left conductive member 16 connects to the left electrode 14 and the two first conductive layers 12, and isolates from the two second conductive layers 13. The right conductive member 17 connects to the right electrode 15 and the two second conductive layers 13, and isolates from the two first conductive layers 12. Each of the left insulating members 18 is disposed in a corresponding left notch and between the left conductive member 16 and the PTC material layer 11 for isolation. Each of the right insulating members 19 is disposed in a corresponding right notch and between the right conductive member 17 and the PTC material layer 11 for isolation. Each of the first insulating layers 20 is in contact with an upper surface of the corresponding first conductive layer 12 and extends from the left conductive member 16 to the right conductive member 17. Each of the second insulating layers 21 is in contact with a lower surface of the second conductive layer 13 and extends from the left conductive member 16 to the right conductive member 17. In an embodiment, each of the left and right electrodes 14 and 15 has two electrode sections on an upper surface of the upper first insulating layer 20 and a lower surface of the lower second insulating layer 21 for surface-mounting onto a circuit board. The upper surface of each of the PTC material layer 11 electrically connects to the left electrode 14 and the lower surface of each of the PTC material layer 11 electrically connects to the right electrode 15, so as to form a circuit in parallel connection Alternatively, the upper surface of the upper PTC material layer 11 and the lower surface of the lower PTC material layer 11 electrically connect to the left electrode 14, and the lower surface of the upper PTC material layer 11 and the upper surface of the lower PTC material layer 11 electrically connect to the right electrode 15, so as to form a circuit in parallel connection as well.

A known surface-mountable over-current protection device uses conductive blind holes to connect to the outer electrodes and the conductive layers of a single PTC device. However, this design cannot be implemented in the applications of a surface-mountable over-current protection device containing multiple PTC devices. There is a limitation that conductive blind holes only can be used for connecting the outer electrodes and the outermost conductive layer of an outermost PTC device, and therefore the conductive layer of an inner PTC device cannot connect to the outer electrode through conductive blind holes. In contrast, the present application makes a breakthrough beyond the limit of conductive blind holes. In an embodiment, the structure shown in FIG. 3C may be selected as a substrate, and two substrates are subjected to aforesaid processes including insulation layer formation, lamination, electrode formation and drilling to form a surface-mountable over-current protection device with a circuit containing two PTC material layers in parallel connection. Similarly, a surface-mountable over-current protection device containing three or more PTC material layers in parallel connection can be accordingly made also.

In an embodiment, the primary portions of the first and second conductive layers use two-ounce (2 oz) copper foils to make a surface-mountable over-current protection device, as shown in FIG. 1, with a thickness of 0.62 mm and a form factor 2920. The conductive filler of the PTC material layer uses conductive ceramic tungsten carbide powder. The device of this embodiment can pass the cycle life test of 4000 cycles at 30V/30 A. However, the traditional over-current protection device without insulating members merely passes cycle life test of 16V. In the test of 30V/30 A, the device is blown at $50^{th}$ cycle due to insufficient voltage endurance. According to test results, the surface-mountable over-current protection device of the present application, in which the PTC material layer uses metal, e.g., nickel, or conductive ceramic powder, e.g., titanium carbide or tungsten carbide as conductive filler, can withstand a voltage of 30V or more; in comparison with the traditional design, the voltage endurance can increase by about 1.5 times.

In high voltage applications, the traditional surface-mountable over-current protection device may incur electric arc due to conductive filler contained in the PTC material layer. In accordance with the present application, the PTC material layer is not in direct contact with the left and right conductive members. It is meant that one more insulating protection mechanism is further introduced to reinforce electrical isolation and enhance voltage endurance. The left and right insulating members serving as spacers may use appropriate insulating resins with specific viscosity and CTE so as to be suitable for large and high aspect ratio hole process and resolve the issues of incomplete filling, bubbles, cracks and delamination during press process.

The above-described embodiments of the present invention are intended to be illustrative only. Numerous alternative embodiments may be devised by persons skilled in the art without departing from the scope of the following claims.

What is claimed is:

1. A surface-mountable over-current protection device, comprising:

a PTC material layer having opposite left and right ends, the left end comprising a left notch, the right end comprising a right notch;

a first conductive layer comprising a primary portion disposed on an upper surface of the PTC material layer and a secondary portion extending over the left notch;

a second conductive layer comprising a primary portion disposed on a lower surface of the PTC material layer and a secondary portion extending over the underside of the right notch;

a left electrode electrically connecting to the first conductive layer;

a right electrode electrically connecting to the second conductive layer;

a left conductive member connecting to the left electrode and the first conductive layer and isolating from the second conductive layer;

a right conductive member connecting to the right electrode and the second conductive layer and isolates from the first conductive layer;

a left insulating member disposed in the left notch and between the left conductive member and the PTC material layer for isolation; and a right insulating member disposed in the right notch and between the right conductive member and the PTC material layer for isolation;

wherein the PTC material layer is not in direct contact with the left and right conductive members, and the primary portion and the secondary portion of the first conductive layer or the second conductive layer have difference thicknesses.

2. The surface-mountable over-current protection device of claim 1, wherein the primary portion is thicker than the secondary portion.

3. The surface-mountable over-current protection device of claim 1, wherein the primary portion is a laminate comprising a first metal layer and a second metal layer, and the secondary portion comprises the second metal layer.

4. The surface-mountable over-current protection device of claim 3, wherein the second metal layer is an electroplated layer on the first metal layer.

5. The surface-mountable over-current protection device of claim 1, wherein the left insulating member and the right insulating member are in the shape of a half cylinder, and the ratio of height to radius of the half cylinder is 1-15.

6. The surface-mountable over-current protection device of claim 1, wherein the first conductive layer has a right end with a notch aligned with the right notch, and the second conductive layer has a left end with a notch aligned with the left notch.

7. The surface-mountable over-current protection device of claim 1, wherein the left notch and right notch are in semi-circular or semi-ellipse shapes, and the left conductive member and the right conductive member are semi-circular or semi-ellipse conductive through holes.

8. The surface-mountable over-current protection device of claim 1, further comprising:

a first insulating layer disposed on an upper surface of the first conductive layer from the left conductive member to the right conductive member; and a second insulating layer disposed on a lower surface of the second conductive layer from the left conductive member to the right conductive member.

9. The surface-mountable over-current protection device of claim 8, wherein the left electrode or the right electrode comprises two electrode sections disposed on an upper surface of the first insulating layer and a lower surface of the second insulating layer.

10. The surface-mountable over-current protection device of claim 8, wherein the first insulating layer and the second insulating layer comprise prepreg.

11. The surface-mountable over-current protection device of claim 8, wherein a material of the first insulating layer and the second insulating layer differ from that of the left insulating member and the right insulating member.

12. The surface-mountable over-current protection device of claim 8, wherein CTE in vertical direction of the left and right insulating members is smaller than CTE in vertical direction of the first and second insulating layers.

13. The surface-mountable over-current protection device of claim 1, wherein the left insulating member and the right insulating member comprise insulating resin without fiberglass.

14. The surface-mountable over-current protection device of claim 13, wherein CTE of the insulating resin at a temperature below Tg is less than 50 ppm.

15. The surface-mountable over-current protection device of claim 13, wherein the insulating resin has a viscosity of 30-60 Pa·s at 25° C.

16. The surface-mountable over-current protection device of claim 1, wherein the left and right insulating members comprise insulating resin with fillers selected from the group consisting of $SiO_2$, $TiO_2$, $Al_2O_3$, $Al(OH)_3$ and $Mg(OH)_2$.

* * * * *